US007562747B2

(12) United States Patent
Marchesi

(10) Patent No.: US 7,562,747 B2
(45) Date of Patent: Jul. 21, 2009

(54) ELEVATOR INSTALLATION AND METHOD FOR DETERMINING AND ANALYZING AN ELEVATOR CAR POSITION

(75) Inventor: Enrico Marchesi, Kilchberg (CH)

(73) Assignee: Inventio AG, Hergiswil NW (CH)

( * ) Notice: Subject to any disclaimer, the term of this patent is extended or adjusted under 35 U.S.C. 154(b) by 680 days.

(21) Appl. No.: 11/200,469

(22) Filed: Aug. 9, 2005

(65) Prior Publication Data

US 2006/0032711 A1 Feb. 16, 2006

(30) Foreign Application Priority Data

Aug. 12, 2004 (EP) ..... 04405508

(51) Int. Cl.
*B66B 3/02* (2006.01)
*B66B 1/34* (2006.01)

(52) U.S. Cl. ..... 187/391; 187/397; 187/399; 187/291; 33/706; 33/708

(58) Field of Classification Search ..... 187/291, 187/391, 394
See application file for complete search history.

(56) References Cited

U.S. PATENT DOCUMENTS

| | | | | |
|---|---|---|---|---|
| 4,433,756 | A | 2/1984 | Caputo et al. | |
| 4,434,874 | A | 3/1984 | Caputo | |
| 4,750,592 | A * | 6/1988 | Watt | 187/394 |
| 4,798,267 | A * | 1/1989 | Foster et al. | 187/389 |
| 5,135,081 | A | 8/1992 | Watt et al. | |
| 5,648,645 | A | 7/1997 | Arpagaus et al. | |
| 5,925,859 | A * | 7/1999 | Miller et al. | 187/394 |
| 6,874,244 | B2 * | 4/2005 | Birrer et al. | 187/294 |
| 2003/0070883 | A1 * | 4/2003 | Foster et al. | 187/394 |
| 2006/0032711 | A1 * | 2/2006 | Marchesi | 187/394 |
| 2007/0227831 | A1 * | 10/2007 | Zaharia | 187/394 |
| 2008/0087502 | A1 * | 4/2008 | Zapf | 187/394 |

FOREIGN PATENT DOCUMENTS

| | | |
|---|---|---|
| DE | 92 10 996.9 | 12/1992 |
| EP | 0 661 228 | 7/1995 |
| WO | WO 03/011733 | 2/2003 |

* cited by examiner

*Primary Examiner*—T C Patel
*Assistant Examiner*—Eduardo Colon-Santana
(74) *Attorney, Agent, or Firm*—Fraser Clemens Martin & Miller LLC; William J. Clemens

(57) ABSTRACT

An elevator installation with at least one car includes at least one device for determining a position of the car and a method of operating such an elevator installation. The position determining device has a code mark pattern and a sensor device. The code mark pattern is arranged along the length of travel of the car and consists of a multiplicity of code marks. The sensor device is mounted on the car and has sensors contactlessly scanning the code marks. The code marks are arranged in a single line and the sensor device comprises at least two sensor groups which are separated from each other perpendicular to the line of the code marks, which makes reading the code marks possible even if there are lateral displacements between the sensor device and the line of the code marks.

10 Claims, 4 Drawing Sheets

(View A2)
(PRIOR ART)

(Section III - III)
(PRIOR ART)

(View A5)

(Section VII-VII)

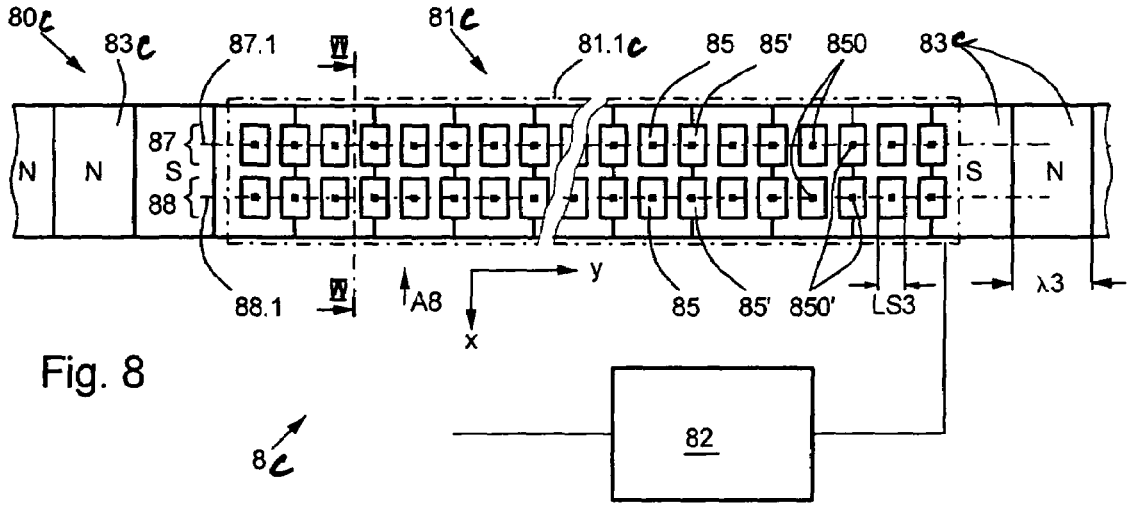
Fig. 8
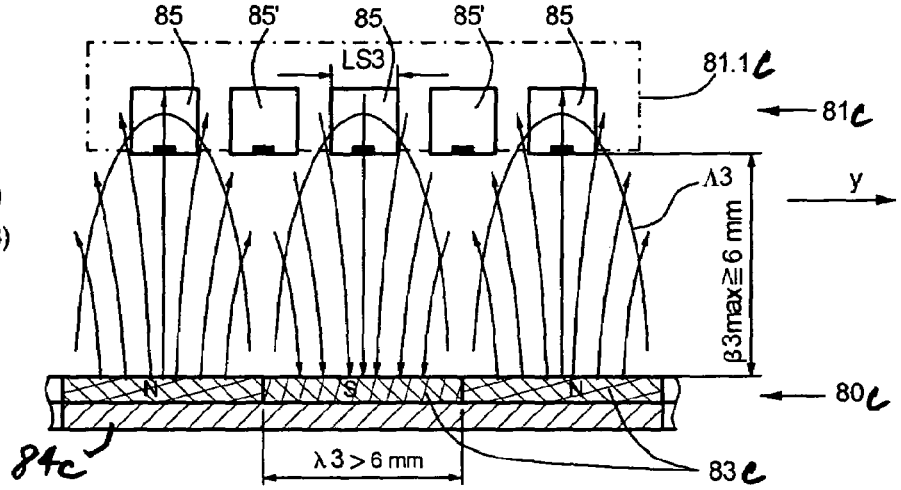
Fig. 9
(View A8)
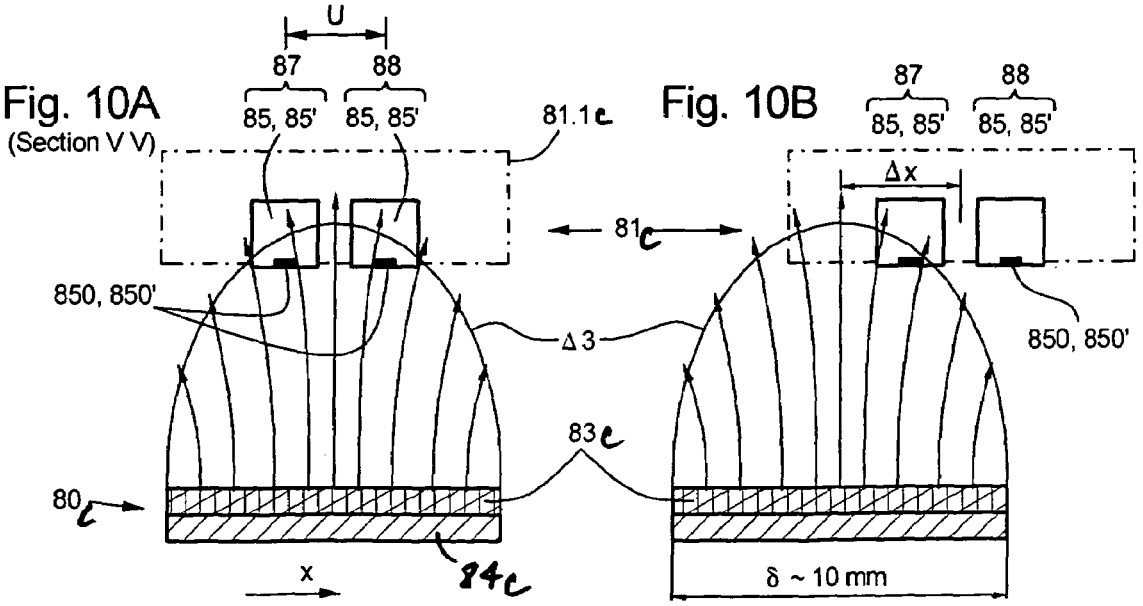
Fig. 10A
(Section V V)
Fig. 10B

ELEVATOR INSTALLATION AND METHOD FOR DETERMINING AND ANALYZING AN ELEVATOR CAR POSITION

BACKGROUND OF THE INVENTION

The present invention relates to an elevator installation with a car and a device for determining a car position and to a method of operating such an elevator installation.

Determining the car position of an elevator installation to derive from this information control signals which are subsequently used by the elevator control is known. Thus, German utility model DE9210996U1 describes a device for determining the car position by means of a magnetic strip and a magnetic head for reading the magnetic strip. The magnetic strip has a magnetic coding and extends along the entire length of travel of the car. The magnetic head which is mounted on the car reads the coding contactlessly. From the coding which is read, a car position is determined.

A further development of this device is disclosed in patent specification WO 03011733A1. According to the description contained in that patent specification, the coding of the magnetic strip consists of a multiplicity of code marks arranged in a line. The code marks are magnetized either as a north pole or as a south pole. Several code marks following in sequence form a code word. The code words themselves are arranged in a sequence as code mark patterns with pseudo-random coding. Thus, each code word represents an absolute car position.

For the purpose of scanning the magnetic fields of the code marks, the device of the patent specification WO 03011733A1 has a sensor device with a plurality of sensors which enables simultaneous scanning of a plurality of the code marks. The sensors convert the different polarities of the magnetic fields into corresponding binary information. For south poles they generate a bit value of "0" and for north poles a bit value of "1". This binary information is analyzed by an analyzer of the device and converted into an absolute position indication which can be understood by the elevator control and used by the elevator control as a control signal. When detecting the magnetic field of the code marks, the resolution of the absolute car position is equal to the length of one code mark, i.e. 4 mm.

The patent specification WO 03011733A1 also describes the use of small, 3 mm long sensors which are arranged in two rows on adjacent tracks so that along the length of one code mark two sensors take up positions which are offset relative to each other along the length of travel by half a pole distance ($\lambda/2$). This arrangement of the sensors has the effect that when the sensors of one row detect a position in the area between two code marks (poles) the sensors of the other row are each in the optimal reading area over a code mark. This ensures that at each occurrence of sensing, to determine the position, that row of sensors is always analyzed whose sensors are positioned in the optimal detection area over the code marks at the moment when sensing occurs.

Disadvantageous in the device of the patent specification WO 03011733A1 is firstly that the sensors must be guided centered with great accuracy of ±1 mm perpendicular to the direction of travel so that the sensors always move within the allowable lateral deviation from the line of the code marks which is given by the lateral boundaries of readability of the magnetic fields of the code marks. In this connection it should be remembered that the strength of the magnetic fields—hereinafter also referred to as the signal strength—diminishes in the direction of the side edges of the code marks.

Also disadvantageous in this known device is that the strength of the magnetic field diminishes rapidly in the perpendicular direction above the code marks and the sensors must therefore be positioned at a small distance of 3 mm above the code marks. For adequate certainty and sufficient reliability of the elevator installation, the sensor device must be elaborately guided over the code mark pattern. This is expensive. Particularly in the case of high car speeds of 10 meters per second the associated outlay is very large.

SUMMARY OF THE INVENTION

A purpose of the present invention is to propose an elevator installation with a car and a device for determining the car position and a method of operating such an elevator installation which enables accurate scanning of a code mark pattern by a sensor device with low cost—especially with low cost for guiding the sensor device relative to the code marks—without impairing the certainty and reliability of the position detection.

The elevator installation according to the present invention has at least one car and at least one device for determining a car position. The device has a code mark pattern and a sensor device. The code mark pattern is placed along the length of the travel path of the car and consists of a multiplicity of code marks arranged in a single line. The sensor device is mounted on the car and scans the code marks contactlessly by means of sensors. The sensor device contains at least two groups of sensors each with a number of sensors, the groups of sensors scanning the code marks redundantly independent of each other. "Scanning redundantly" is to be understood as meaning that, in the normal operating state and in every allowable position of the car, at least the sensors of one of the groups of sensors deliver to the analyzer the complete information corresponding to the current position of the car.

An advantage of the present invention lies in the substantially greater certainty and reliability that, in the normal operating state and in every allowable position of the car, the sensor device delivers to the analyzer and therefore to the elevator control the correct information regarding the current position of the car.

According to a particularly preferred embodiment of the present invention, the sensor groups are at a suitable distance from each other perpendicular to the direction of their line. This has the effect that, for a given pattern of the signal strength of-the code marks, largest possible lateral offsets between the sensor device and the line of the code marks as well as largest possible distances between the code marks and the sensors are allowable, since the sensor groups detect the magnetic fields of the code marks independent of each other, there being always at least one of the two sensor groups positioned in a favorable area of the code mark signal strength even if the sensor device is relatively greatly offset relative to the line of the code marks in the direction perpendicular to the direction of travel. Furthermore, by this means the width of the code marks measured perpendicular to the direction of travel can be kept relatively small, which has substantial advantages in relation to the limited space for building-in the code mark pattern as well as in relation to the method of its production and the costs of its production.

It is advantageous for the distance between the two sensor groups to be so chosen that at least the sensors of one of the two sensor groups deliver the complete information regarding the current position of the car, provided that measured perpendicular to the line of the code marks the deviation of the current position of the sensor device from its centered position relative to the line of the code marks does not exceed a value of 25%, preferably 30%, of the width of the code marks.

It is advantageous for the distance between the two sensor groups to be so chosen that each of the two sensor groups can scan the complete code word corresponding to the current position of the car—i.e. can deliver the complete information regarding the current position of the car—provided that, measured perpendicular to the line of the code marks, the deviation of the position of the sensor device from its optimal position relative to the line of the code marks does not exceed a value of, for example, 10%, preferably 15%, of the width of the code marks.

According to an expedient embodiment of the present invention, the sensors which are respectively assigned to a sensor group are arranged in two lines of sensors running parallel to the line of the code marks. This embodiment has the advantage that sensors can also be used whose housing dimensions do not permit their arrangement on a single line.

According to a particularly preferred embodiment of the present invention, the sensors which are respectively assigned to a sensor group are each arranged in a single line parallel to the line of the code marks. By using one single line for the code marks and one single line for the sensors of each sensor group, efficient and loss-free scanning of the code marks takes place in an area in which these display a high signal strength. This takes account of the fact that, not only does a given signal strength of the code marks diminish toward the edges of the code marks but it also diminishes with increasing distance from the surface of the code marks. The efficient and loss-free scanned signal strengths of the code marks, in conjunction with the use of two complete sensor groups spaced from each other perpendicular to the direction of their line, result in a greatest possible range of confidence, i.e. in a large range of the possible position of the sensors relative to the code marks in which the sensors can scan the code marks certainly and reliably with sufficiently strong sensor signals. It is thus possible to devise the range of confidence intentionally, i.e. to optimize mutually dependent allowable ranges of the distance between the code marks and the sensors as well as the lateral offset of the sensor devices relative to the line of the code marks. With the proposed means, the outlay cost for guiding the sensor device relative to the code mark pattern is reduced without the certainty and reliability of the position detection of the car, and therefore of the elevator installation, being impaired.

It is expedient for the analyzer which processes the signals of the sensors to be so designed that if, as a result of a deviation of the position of the sensor device from its optimal position relative to the line of the code marks, the two sensor groups deliver different information, it combines the different information into an information which represents the actual current position of the car.

It is advantageous for the analyzer to be so designed that it compares the signals received from the two sensor groups and saves or displays information if the received signals deviate from each other during a defined period of time or during a defined number of trips of the car.

Favorable maximum allowable distances between the code marks and the sensors of the sensor device are attained through the code marks having a mark length $\lambda > 5$ mm.

It is advantageous for the sensors to be so guided over the code marks that a maximum distance between the sensors and the code marks of 100% of the width of the code marks is not exceeded.

DESCRIPTION OF THE DRAWINGS

The above, as well as other advantages of the present invention will become readily apparent to those skilled in the art from the following detailed description of a preferred embodiment when considered in the light of the accompanying drawings in which:

FIG. 8 is a schematic plan view of a device for determining the position of the car with a sensor device and a code mark pattern according to a second embodiment of the present invention;

FIG. 9 is an enlarged fragmentary side view of the device taken in the direction of the arrow A8 of FIG. 8;

FIG. 10A is a cross-section through the device taken along the line VV-VV of FIG. 8; and FIG. 10B is a cross-section through the device shown in FIG. 8, similar to FIG. 10A, with two sensor groups arranged offset over the line of the code marks.

DESCRIPTION OF THE PREFERRED EMBODIMENT

Figure 1:
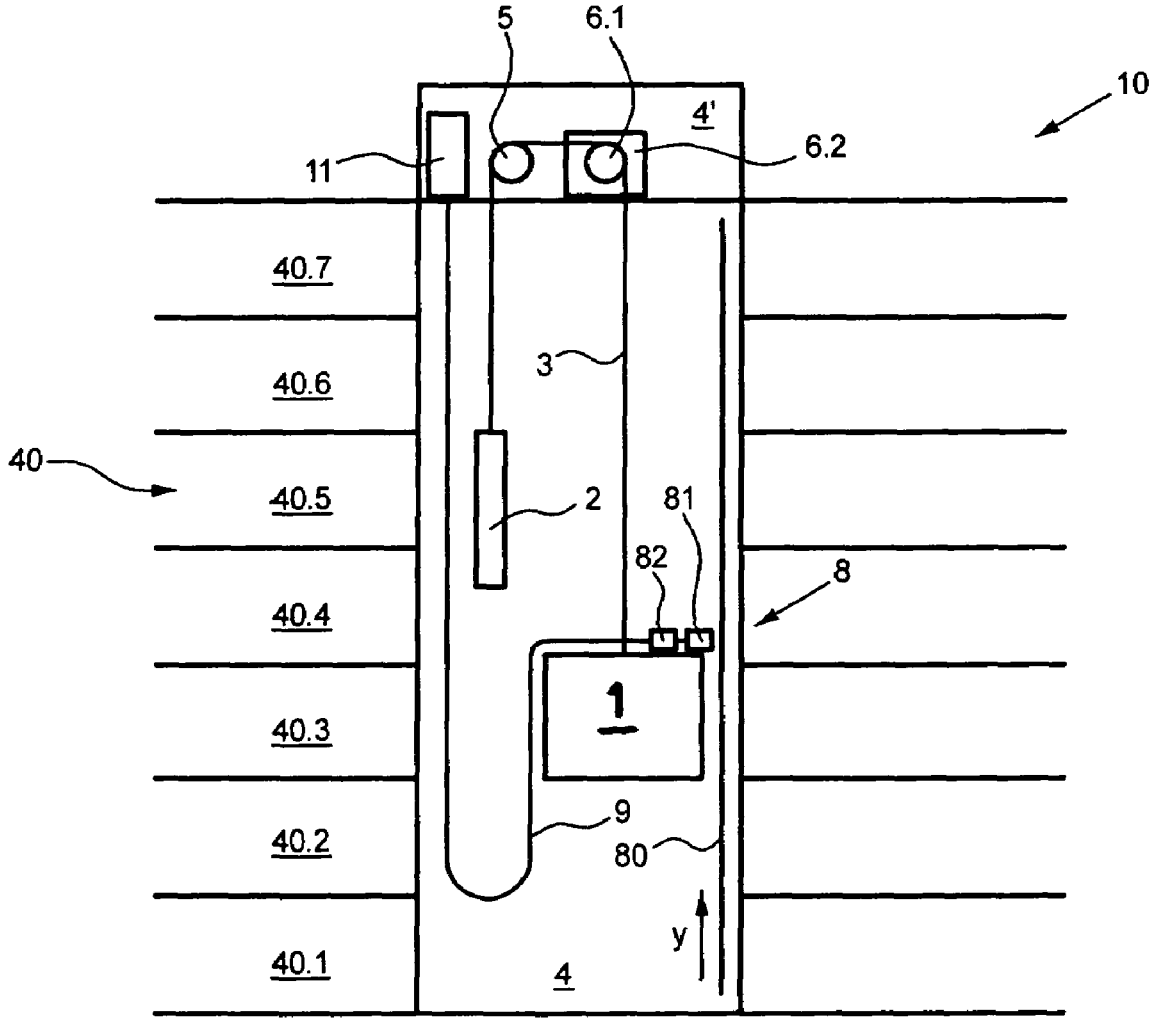
FIG. 1 is a schematic elevation view of an elevator installation with a car and a device for determining the position of the car.

FIG. 1 shows schematically an elevator installation 10 according to the present invention. A car 1 and a counterweight 2 are suspended from at least one suspension rope 3 in a hoistway 4 in a building 40. The suspension rope 3 passes over a diverter sheave 5 and is driven via a traction sheave 6.1 by a drive 6.2. The diverter sheave 5, the traction sheave 6.1, and the drive 6.2 can be arranged in a separate machine room 4' but they can also be located directly in the hoistway 4. Through rotation of the traction sheave 6.1 to the left or right, the car 1 is caused to travel along a travel path in, or opposite to, a direction of travel "y" and serve floors 40.1 to 40.7 of the building 40.

A device 8 for determining the position of the car has a code mark pattern 80 with code marks, a sensor device 81, and an analyzer 82. The code mark pattern 80 has a numeric coding of absolute positions of the car 1 in the hoistway 4 relative to a reference point. The code mark pattern 80 is attached in a positionally fixed manner in the hoistway 4 along the entire travel path of the car 1. The code mark pattern 80 can be freely stretched in the hoistway 4 or fastened to hoistway walls or guiderails of the elevator installation 10. The sensor device 81 and the analyzer 82 are mounted on the car 1. The sensor device 81 is therefore caused to move along with the car 1 and when doing so contactlessly scans the code marks of the code mark pattern. For this purpose, the sensor device 81 is guided at a small distance from the code mark pattern 80. For this purpose, the sensor device 81 is mounted on the car 1 perpendicular to the travel path by means of a mounting. According to FIG. 1, the sensor device 81 is fastened on the car roof but it is self-evidently also entirely possible to mount the sensor device 81 on the side of, or under, the car 1. The sensor device 81 passes the scanned information to the analyzer 82. The analyzer 82 translates the scanned information into an absolute position indication which is capable of being understood by an elevator control 11. This absolute position indication is passed to the elevator control 11 via a traveling cable 9. The elevator control 11 uses this absolute position indication for diverse purposes. For example, it serves to control the travel curve (speed versus distance) of the car 1, as by the application of decelerating and accelerating measures. It also serves to control deceleration at the end of the hoistway, to monitor the hoistway end limits, to recognize floors, to accurately position the car 1 at the floors 40.1 to 40.7, and naturally also to measure the speed of the car 1.

With knowledge of the present invention, the specialist can self-evidently realize other elevator installations with other types of drives such as hydraulic drive, etc., or elevators with no counterweight, as well as wireless transmission of position indications to an elevator control.

FIGS. 2 to 10B show the construction of parts of the devices 8 for determining the position of the car with the code mark pattern 80 and the sensor device 81 which encompasses a number of sensors 85, 85' which are integrated in a sensor housing 81.1 indicated by a broken line. In the following description, the reference numerals for like devices are distinguished with "a", "b" and "c" for different embodiments.

Figure 2:
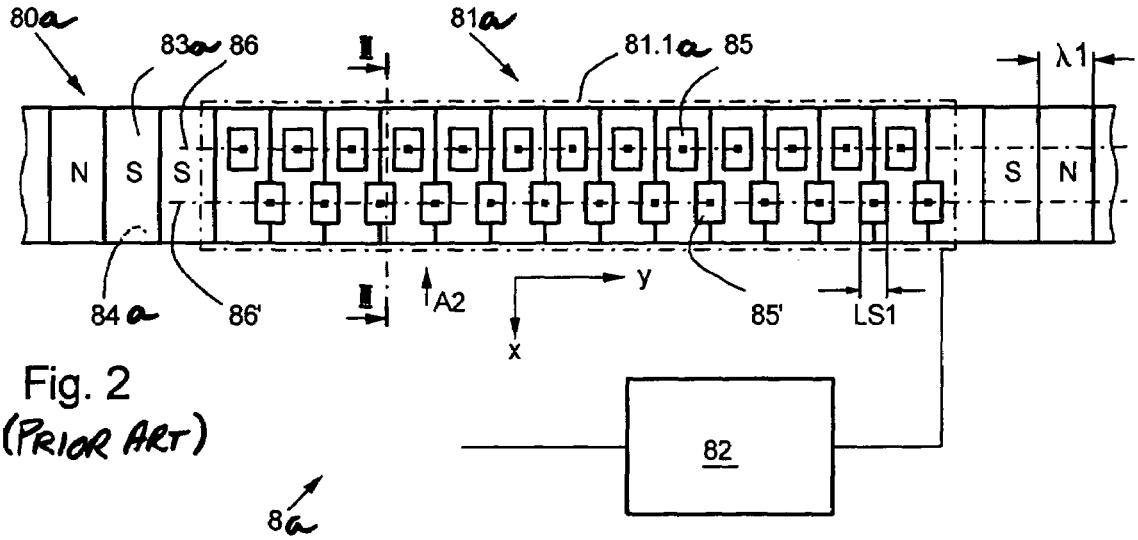
Fig. 2 (PRIOR ART)
FIG. 2 is a schematic plan view of a device for determining the position of the car with a sensor device and a code mark pattern according to the prior art patent specification WO 03011733A1.

FIG. 2 shows an embodiment of a device 8*a* for determining the position of the car according to the prior art patent specification WO 03011733A1. Shown schematically are a code mark pattern 80*a* with code marks 83*a* which is arranged in the hoistway in a positionally fixed manner in the direction of travel of the car 1, a sensor device 81 with the 85, 85' which are integrated in a sensor housing 81.1*a* and scan the code mark pattern 80*a*, as well as the analyzer 82. The sensor device 81*a* contains one single sensor group which is arranged in two rows of sensors 86 and 86', each of the sensor rows 86, 86' having a number "n" of the sensors 85 and 85' respectively with a sensor length LS1. In the present example, thirteen sensors are shown in each row. However, the number "n" of the sensors is freely selectable depending on the length of travel, the desired resolution of the distance, and possibly further conditions. The distances between the sensors correspond to the length $\lambda 1$, or half of the length $\lambda 1/2$, of the code marks 83*a*.

The code marks 83*a* consist of sections of a magnetizable strip, the sections in the direction facing the sensors forming magnetic south poles or north poles which are detected by the sensors as bit value "0" or bit value "1". The sequence of the south poles and north poles corresponds to the bit sequence of a pseudo-random coding by means of which it is ensured that, after every movement of the sensor device by the length of one code mark, a new n-digit (here 13-digit) bit sequence, which occurs only once over the entire length of the travel path, occurs and is detected by the "n" sensors of the sensor device following one after the other and assigned to a unique position of the car 1 by the analyzer 82.

The two sensor rows 86 and 86' of the sensor device 81*a* with the respectively assigned sensors 85 and 85' are mutually offset in the direction of travel (y direction) by half a pole division, i.e. by half of the length $\lambda$ of the code mark 83*a*. This has the effect that in every possible position of the car, the sensors of one of the lines of sensors lie in the area above the middle of the code marks and in each case detect unequivocal south poles and north poles. Before each position-reading cycle, the analyzer 82 determines which of the two lines of sensors has sensors close to a zero-field transition between changing magnetic poles of the code marks 83*a* and then reads the values of the sensors of the respective other line of sensors.

The sensors 85 and 85' are arranged in the two parallel lines of sensors 86 and 86' because two sensors both with the given length LS1 have insufficient space within the relatively short length $\lambda 1$, of the code marks 83*a*.

Figure 3:
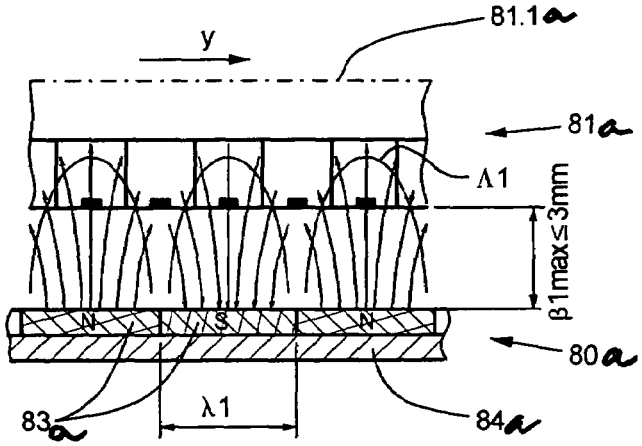
FIG. 3 is an enlarged fragmentary side view of the device taken in the direction of the arrow A2 of FIG. 2.

FIG. 3 shows an enlarged side view (arrow A2) of the code mark pattern 80*a* shown in FIG. 2 and, positioned over the code mark pattern 80*a*, of the sensor device 81*a* of the device 8*a* according to the prior art. Shown are the magnetized code marks 83*a* mounted on a carrier 84*a* which have a relatively short length $\lambda 1$ of 4 mm. As a result of the relatively short distances between adjacent north and south poles, the magnetic fields influence each other in such manner that the magnetic field strengths detectable by the sensors as an unequivocal signal extend only to a relatively small height above the code marks. The boundaries of detectable magnetic field strengths in the direction of the line of the code marks are suggested by parabolic curves $\Lambda 1$ and are also designated as boundaries of a range of confidence which encompasses all possible positions of the sensors in relation to the code marks in that, with sufficiently strong sensor signals, the sensors can scan the code marks certainly and reliably. The sensors 85, 85' integrated in the sensor housing 81.1*a* must therefore be so guided that during a trip of the car their distance $\beta 1$max from the code marks 83*a* does not exceed the value of 3 mm, which has the consequence that the guidance between the sensor device 81*a* and the code mark pattern 80*a* requires a substantial cost outlay.

Figure 4:
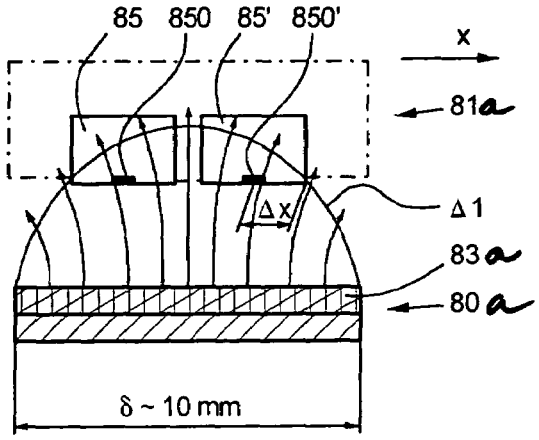
FIG. 4 is a cross-section through the device taken along the line II-II of FIG. 2.

FIG. 4 shows a cross-section through the code mark 83*a* viewed along the length (y direction) of the code mark pattern 80*a*, and the sensor device 81*a* according to the aforesaid state of the art arranged over it. Also to be seen are two of the sensors 85 and 85' integrated in the sensor housing 81.1*a* with their active sensor surfaces 850 and 850'. A curve $\Delta 1$ of the boundaries of the magnetic field strengths perpendicular to the line of the code marks which are unequivocally detectable by the sensors (confidence range in perpendicular direction) indicates that the magnetic field strength of the code marks also diminishes substantially in the area of the side edges of the code marks. From FIG. 4 it is readily apparent that, even with a relatively small lateral offset $\Delta x$ (approx. 1 mm in the x direction) between the sensor device 81*a* and the approximately 10 mm wide code mark pattern 80*a*, one of the active sensor surfaces 850, 850' leaves the area of detectable magnetic field strength with the consequence that a correct reading of the position of the car 1 is made impossible. This, too, can only be prevented by elaborate guidance of the sensor device 81*a* relative to the code mark pattern 80*a*.

Figure 5:
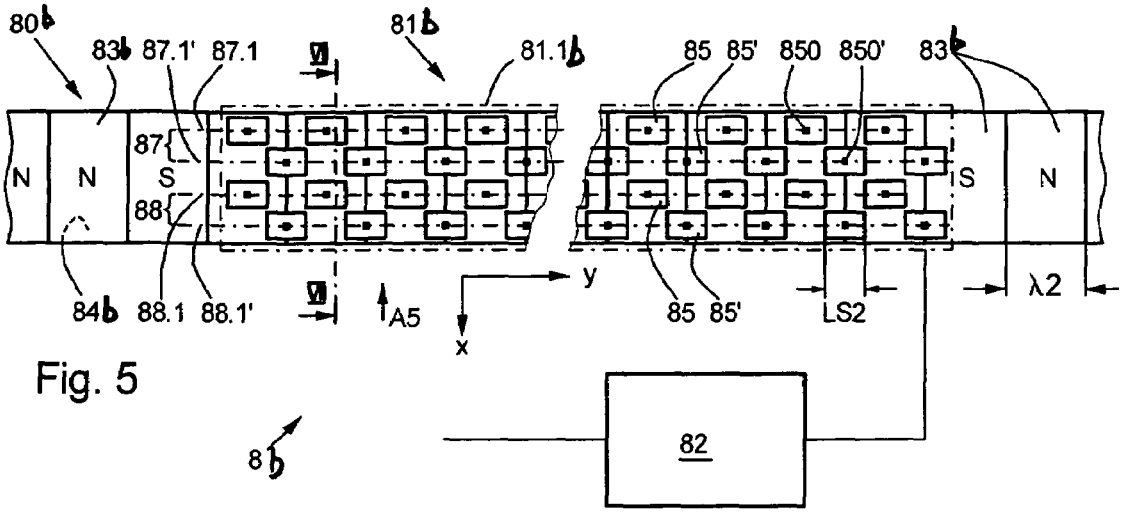
FIG. 5 is a schematic plan view of a device for determining the position of the car with a sensor device and a code mark pattern according to a first embodiment of the present invention.

FIG. 5 shows a first embodiment of a device 8*a* for determining the car position according to the present invention. Shown again are a single-line code mark pattern 80*b* with code marks 83*b* of length $\lambda 2$ which is arranged in the elevator hoistway in a positionally fixed manner, a sensor device 81*b* with a number of the sensors 85, 85' which are integrated in a sensor housing 81.1*b* and scan the code mark pattern 80*b*, and the analyzer 82. According to the present invention, the sensor device 81*b* contains two complete sensor groups 87 and 88 which each have two rows of sensors 87.1, 87.1' and 88.1, 88.1', each of which encompasses a number of the sensors 85 and 85' respectively. In each case, along the length of travel the sensors 85' are arranged offset by half the length $\lambda 2/2$ of the code marks 83*b* relative to the sensors 85. Each of the two complete sensor groups 87, 88 has essentially the same functions as the sensor group of FIG. 2 described above. Both of the sensor groups 87, 88 scan the code marks 83*b* redundantly, i.e. each of them is able independently of the other to register and deliver to the analyzer the complete information regarding the current position of the car 1 provided that the active sensor surfaces 850, 850' of the respective sensors 85, 85' are over the code marks within the boundaries of detectable magnetic field strength.

Furthermore, in the embodiment shown in FIG. 5, the length λ2 of the code marks 83*b*—relative to those of FIG. 2—have been lengthened from approximately 4 mm to from 5 to 10 mm.

Figure 6:
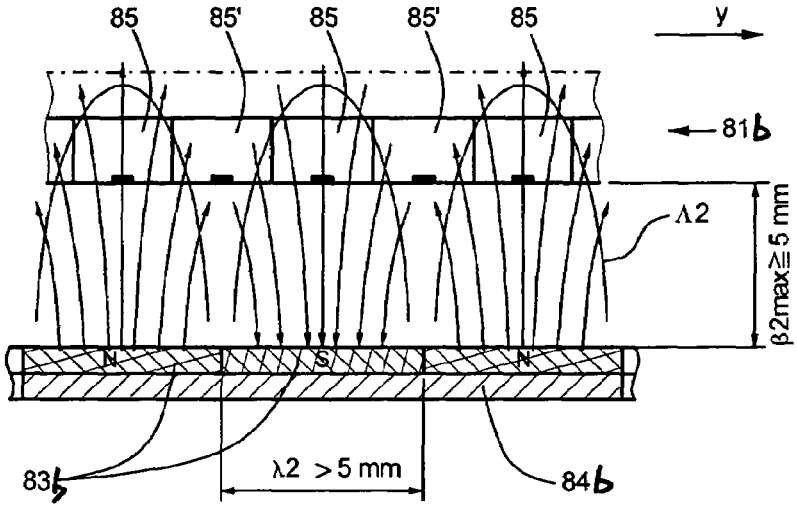
FIG. 6 is an enlarged fragmentary side view of the device taken in the direction of the arrow A5 of FIG. 5.

FIG. 6 shows an enlarged side view (arrow A5) of the code mark pattern 80*b* shown in FIG. 5 and of the sensor device 81*b* of the first embodiment according to the present invention of the device 8*b* positioned over the code mark pattern 80*b*.

Noticeable are the code marks 83*b* which have been lengthened by comparison with the state of the art and which now have a length λ2 of at least 5 mm, preferably 6 to 10 mm. Despite the mutual effects of adjacent south and north poles which are also present, thanks to the greater length of the code marks magnetic fields can occur in the area of their midpoints whose detectable boundaries extend to substantially greater heights above the code marks, typically heights of 10 mm and more. By this means it is possible for the distances between the active surfaces of the sensors 850, 850' and the code marks 83*b* to be varied from approximately 1 mm up to a maximum distance β2max of more than 5 mm while the elevator is in operation. It is expedient for the sensor device 81*b* to be guided over the code marks 83*b* in such manner that a maximum distance between the sensors 85, 85' and the code marks 83*b* of 75% of a width δ of the code marks cannot be exceeded.

Figure 7A:
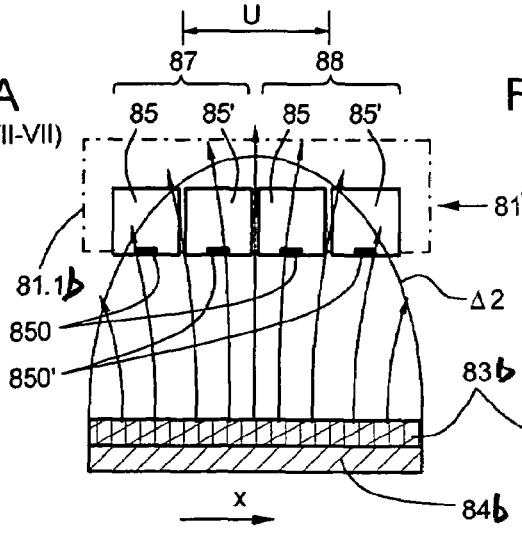
FIG. 7A is a cross-section through the device taken along the line VII-VII of FIG. 5.

FIG. 7A shows a cross-section through the code mark 83*b* of the code mark pattern 81*b* according to the first embodiment of the invention shown in FIG. 5 viewed in the longitudinal direction (y direction) of the code mark pattern 80*b*, and the sensor device arranged above it. Visible in this cross-section are four of the sensors 85, 85' with their active sensor surfaces 850, 850' which are integrated in the sensor housing 81.1*b*. By comparison with the prior art device 8*a*, the distance between the sensor surfaces and the code marks has been enlarged by approximately 50%, i.e. from approximately 4 mm to approximately 6 mm. The two sensors 85, 85' shown to the left of the center belong to the sensor group 87, and the two sensors 85, 85' shown to the right of the center belong to the sensor group 88, the two sensor groups being separated from each other by a distance U perpendicular to the line of the code marks (in the x direction). In the position of the sensor housing 81.1*b* shown in FIG. 7A, all of the active sensor surfaces 850, 850' of the sensors lie within the boundary of the magnetic strength which is unequivocally detectable by the sensors and symbolized by the curve Δ2 (range of confidence in the perpendicular direction). In this centered position relative to the line of the code marks 83*b*, each of the two sensor groups 87 and 88 can detect the complete coded information about the current position of the car 1 and pass it to the analyzer. For the reason stated in association with FIG. 2, the sensors 85 and 85' which belong to one of the two sensor groups 87 and 88 respectively, are placed offset relative to each other in the direction of travel y by half of the length λ2/2 of the code marks, and in the embodiment described here are arranged in each case in two rows of sensors 87.1, 87.1' and 88.1, 88.1' per sensor group 87, 88. This arrangement was chosen because in this embodiment the relationship between the length λ2 of the code marks 83*b* and the length LS2 of the sensors does not allow an in-line arrangement of the sensors 85 and 85'.

Figure 7B:
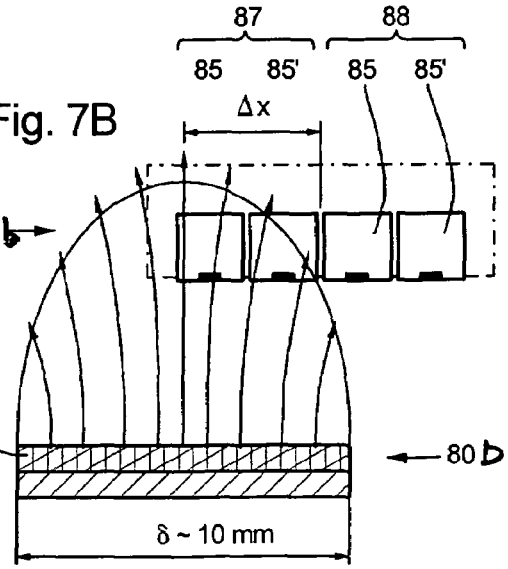
FIG. 7B is a cross-section through the device shown in FIG. 5, similar to FIG. 7A, with two sensor groups arranged offset along the line of the code marks.

FIG. 7B shows the cross-section according to FIG. 7A, the sensor device 81*b* being positioned offset by Δx perpendicular to the direction of travel relative to the line of the code mark pattern 80*b*. In the case of the shown offset by more than 30% of the width δ of the code marks, the sensor surfaces of the sensors 85, 85' of the sensor group 88 lie outside the boundary marked by the curve Δ2 for the magnetic field strengths detectable by the sensors and are therefore no longer effective. However, the sensor surfaces of the sensors 85, 85' of the sensor group 87 still lie within the aforesaid boundary and thereby ensure the full functional capability of the sensor device, and therefore of the entire device according to the invention, even with the extreme offset shown.

Here, the analyzer 82 combines the different information which the two sensor groups deliver in the situation shown into one information which represents the actual current position of the car 1. It is readily apparent that with the sensor arrangement shown, the demands on the guidance system which guides the sensor unit 81*b* relative to the code mark pattern 80*b* can be greatly reduced.

FIG. 8 shows a second embodiment according to the invention of a device 8*c* for determining the position of the car. Shown again are an elevator hoistway with a single-line code mark pattern 80*c* arranged in a positionally fixed manner with code marks 83*c* of length λ3, a sensor device 81*c* with a number of the sensors 85, 85' which scan the code mark pattern 80*c* and are integrated in a sensor housing 81.1*c*, and the analyzer 82. According to the present invention, this sensor device 81*c* also contains two complete sensor groups 87, 88. Each of the two sensor groups encompasses sensors 85 and, offset by half of their respective length (λ3/2) relative to these in the direction of travel y, sensors 85', in the present variant embodiment all of the sensors 85 and 85' which are assigned to one of the sensor groups 87, 88 respectively being arranged in one single sensor line 87.1, 88.1. The latter is possible in this case because the relationship between the length λ3 of the code marks 83*c* and the length LS3 of the sensors allows an in-line arrangement of the sensors 85 and 85'.

Each of the two complete sensor groups 87, 88 has essentially the same functions as the sensor group according to the state of the art described above and is capable of registering the complete information about the current position of the car 1 provided that the active sensor surfaces 850, 850' of their sensors 85, 85' are over the code marks within the boundaries of detectable magnetic field strength. In the embodiment of the invention described here, the length λ3 of the code marks 83*c*—compared with those of the aforementioned state of the art—has been lengthened from approximately 4 mm to from 6 to 10 mm.

FIG. 9 shows an enlarged side view (arrow A8) of the code mark pattern 80*c* shown in FIG. 8 and of the sensor device 81*c* of the second embodiment of the present invention 8*c* positioned over the code mark pattern 80*c*. Visible are the code marks 83*c*, which by comparison with the state of the art have been lengthened, and now have the length λ3 of at least 6 mm, preferably 7 to 10 mm. Despite the mutual influence of adjacent south and north poles which is also present, thanks to the greater length of the code marks, magnetic fields can form in the area of their midpoints whose detectable boundaries (curves Λ3) extend to substantially greater heights above the code marks, typically to heights of more than 10 mm. By this means it is made possible for the distances between the active sensor surfaces 850, 850' and the code marks 83*c* to be varied from approximately 1 mm up to a maximum distance of β3max during operation of the elevator. When doing so, the maximum effective distance β3max can be up to 100% of the width δ of the code marks.

Also apparent from FIG. 9 is that with the present relationship between the length λ3 of the code marks 83*c* and the length LS3 of the sensors 85, 85', the sensors 85 and 85' which are assigned respectively to a sensor group 87, 88 can be integrated in the sensor housing 81.1*c* in a single line of sensors and with sufficient distance between them.

FIG. 10A shows a cross-section through the code mark 83*c* of the code mark pattern 80*c* viewed in the longitudinal direction (y direction) of the code mark pattern 80*c* and the sensor device 81*c* arranged over it corresponding to the second embodiment of the invention shown in FIG. 8. Visible in this cross section are the two sensors 85, 85' with their active sensor surfaces which are integrated in the sensor housing 81.1*c*. The sensor 85, 85' which is shown to the left of center belongs to the sensor group 87, and the sensor 85, 85' which is shown to the right of center belongs to the sensor group 88, the two sensor groups being spaced by the distance U perpendicular to the line of the code marks (in the x direction). In the sensor housing 81.1*c* shown in FIG. 10A which is centered over the line of the code marks 83*c*, all active sensor surfaces 850, 850' of the sensors 85, 85' lie within the boundary of the magnetic field strength perpendicular to the line of the code marks which is unequivocally detectable by the sensors and symbolized by the curve Δ3 (area of confidence in the perpendicular direction).

In the embodiment described here, the sensors 85 and 85', which in each case belong to one of the two sensor groups 87 and 88, are placed mutually offset by half of the length λ3/2 of the code marks in the direction of travel y (for the reason explained in association with FIG. 2) and arranged in one single line of sensors 87.1 and 88.1 per sensor group 87, 88. This arrangement can be realized with the present embodiment because the relationship between the length λ3 of the code marks 83*c* and the length LS3 of the sensors allows an in-line arrangement of the sensors 85 and 85' of each sensor group 87, 88. With this arrangement of the sensors, the distance measured between the active sensor surfaces 850, 850' of the external sensors perpendicular to the direction of travel is substantially less than in the arrangement according to FIGS. 5 to 7B. This makes it possible to realize even greater distances between the active sensor surfaces 850, 850' and the code marks 83*c*.

In this centered position of the sensor housing 81.1*c* relative to the line of the code marks 83*c*, each of the two sensor groups 87 and 88 can detect the complete coded information about the current position of the car 1 and pass it to the analyzer.

FIG. 10B shows the cross-section according to FIG. 10A, the sensor device 81*c* being positioned offset by Δx perpendicular to the direction of travel relative to the line of the code marks 83*c*. In the shown extreme offset by more than 30% of the width δ of the code marks, the sensor surfaces 850, 850' of the sensors 85, 85' of the sensor group 88 lie outside the boundary of the magnetic field strengths detectable by the sensors marked by the curve Δ3 and are therefore no longer effective. However, the sensor surfaces of the sensors 85, 85' of the sensor group 87 still lie within the aforesaid boundary and lend the sensor device 8*c*, and therefore the entire device according to the present invention, the full functional capability even with the extreme offset shown.

Here, the analyzer 82 combines the different information which the two sensor groups in the situation shown deliver into one information signal which represents the actual current position of the car 1.

It is readily apparent that, with the sensor arrangement shown, an optimal relationship between the maximum allowable distance of the sensor surfaces from the code markers and the allowable offset of the sensor device relative to the line of the code markers can be set, and that the demands on the accuracy of the guidance system which guides the sensor unit 81*c* over the code mark pattern 80*c* can be greatly reduced.

Regarding the code mark pattern:

The code mark pattern 80*b*, 80*c* consists of a multiplicity of the code marks 83*b*, 83*c* mounted on the carrier 84*b*, 84*c*. It is preferable for the code marks to have high coercive field strengths. The carrier 84*b*, 84*c* is, for example, a steel tape with a carrier thickness of 1 mm and a carrier width of 10 mm. The code marks 83*b*, 83*c* can, for example, be sections of a plastic tape which contains magnetic particles. The mark thickness can be, for example, 1 mm and the mark width δ 10 mm. The code marks 83*b*, 83*c* are arranged on the carrier 84*b*, 84*c* in the longitudinal direction y one after the other at equal distances and form rectangular sections of equal length. The longitudinal direction y corresponds to the direction of travel y according to FIG. 1. The code marks 83*b*, 83*c* are magnetized as either south poles or north poles. It is advantageous for them to be magnetized to saturation. For iron as the magnetic material of the code marks, the saturation magnetization is 2.4 T. The code marks have a given signal strength, for example they are manufactured with a certain magnetization of ±10 mT. A south pole forms a negative magnetic field and a north pole a positively oriented magnetic field. Selfevidently, with knowledge of the present invention, code mark patterns of other dimensions with wider or narrower mark widths as well as thicker or thinner mark thicknesses can be used. Besides iron as the magnetic material for the code marks, any other industrially proven and inexpensive magnetic materials can be used, for example rare earths such as neodymium, samarium, etc. or magnetic alloys or oxidic materials or polymer-bonded magnets.

Regarding the mark dimensions:

The differences between the code mark patterns 80*a*, 80*b*, 80*c* in the embodiments of the device 8*a*, 8*b*, 8*c* for determining the car position are that in the embodiment from the state of the art 8*a* according to FIG. 2 the mark length λ1=4 mm while in the further development 8*b* according to FIGS. 5, 6, 7A and 7B, and in the embodiment according to the present invention 8*c* shown in FIGS. 8, 9, 10A and 10B, the mark length λ2 is >5 mm (preferably 6 mm or 7 mm). The code marks 83*b* in the further development, and in the embodiment according to the present invention 83*c*, are therefore longer than the code marks 83*a* in the state of the art.

Regarding the sensor device:

The sensor device 81*a*, 81*b*, 81*c* scans the magnetic fields of the code marks 83*a*, 83*b*, 83*c* viewed in the longitudinal direction y with a multiplicity of the sensors 85, 85' arranged at the same distance from each other. As regards mechanical dimensions and sensitivity, the sensors 85, 85' used in the three embodiments of the device 8*a*, 8*b*, 8*c* for determining the car position are identical. For the sensors 85, 85' it is preferable to use inexpensive and simply controllable and readable Hall sensors. The sensors 85, 85' form, for example, rectangular sections of equal length with a long side of 3 mm and a short side of 2 mm. The sensors 85, 85' are, for example, sensors on carriers in which one sensor bounds the long side and the short side and the actual sensor surface 850, 850' has a significantly smaller dimension of, for example, 1 $mm^2$. In the case of Hall sensors, the sensor surface 850, 850' is typically arranged centrally within the sensors. The sensors 85, 85' detect via the sensor surfaces 850, 850' the magnetic fields of the code marks 83*a*, 83*b*, 83*c* as sensor signals. The stronger the signal strength of the code marks 83*a*, 83*b*, 83*c*, the stronger the sensor signal of the sensors 85, 85'. Typical sensitivities of Hall sensors are 150 V/T. For the magnetic fields of the code marks 83*a*, 83*b*, 83*c* which are registered as analog voltages, the sensors 85, 85' deliver binary information. For a south pole they deliver a bit value of "0" and for a north pole they deliver a bit value of "1". However, with knowledge of the present invention, the expert can also use other magnetic sensors. He/she can also use differently dimensioned sensors with longer or shorter long sides and/or with longer or shorter short sides. The expert can also use more sensitive or less sensitive Hall sensors.

Regarding the coding:

The code mark pattern 80*a*, 80*b*, 80*c* has a binary pseudo-random coding. The binary pseudo-random coding comprises sequences with "n" bit values of "0" or "1" arranged gaplessly one after the other. With each advance by one bit value in the binary pseudo-random coding, a new n-digit sequence with bit values of "0" or "1" comes into existence. Such a sequence of "n" successive bit values is referred to as a code word. A code word with, for example, a 13-digit sequence is used. On simultaneous scanning of in each case thirteen successive code marks 83*a*, 83*b*, 83*c* of the code mark pattern 80*a*, 80*b*, 80*c*, the 13-digit sequence is read out uniquely and without repetition of code words. The sensor device 81*a*, 81*b*, 81*c* correspondingly comprises thirteen of the sensors 85, 85' for reading the code words. Self-evidently, with knowledge of the present invention, the expert can realize sensor devices with longer or shorter code words and correspondingly more or less sensors. It is also possible to realize so-called Manchester coding which results if, in a pseudo-randomly coded bit sequence, after each south pole code mark an inverse north pole code mark is inserted and vice versa. The zero-value transitions of the magnetic field which are thereby enforced after a maximum of every second code mark serve particularly the application of an interpolation device which allows a higher resolution of the position measurement. Additional sensors are integrated in the sensor device for the interpolation device. However, in relation to the present invention, the method of interpolation is irrelevant. The combination of the pseudo-random coding with the Manchester coding described has the consequence that the sensors of the sensor device must be arranged with a separation which corresponds to twice the length of the code marks (2λ).

Regarding the confidence range:

The magnetic fields are represented by curved arrows above the code marks. The signal strength of the code marks 83*a*, 83*b*, 83*c* is strongest in the middle of the code marks and diminishes toward the edges of the code marks. The signal strength of the code marks 83*a*, 83*b*, 83*c* also diminishes from a certain distance above the code marks. An area with sufficiently strong magnetic fields above the code marks 83*a*, 83*b*, 83*c* in which the code marks can be certainly and reliably scanned by the sensor device 81*a*, 81*b*, 81*c* is referred to as an area of confidence. The area of confidence is determined by the signal strength of the code marks 83*a*, 83*b*, 83*c*, the dimension of the code marks, and the sensitivity of the sensors 85, 85'. To be capable of delivering valid information, the sensor surfaces 850, 850' of the sensors 85, 85' must lie within the area of confidence with a tolerance of, for example, ±1 mm. The curve Λ1 bounds the area of confidence in the longitudinal direction y of the device 8*a* for determining the position of the car according to the state of the art shown in FIGS. 2, 3 and 4. The curves Λ2, Λ3 bound the area of confidence in the longitudinal direction y of the devices 8*b*, 8*c* for determining the position of the car according to the embodiments according to the present invention shown in FIGS. 5-10B.

In the embodiment according to the state of the art (FIGS. 2, 3 and 4), the lengths λ1 of the code marks 83*a* are shorter than the lengths λ2, λ3 in the embodiments according to the present invention shown in FIGS. 5-10B. Because of this, the height of the curve Λ1 is lower than the height of the curves Λ2, Λ3. The shorter code marks 83*a* from the state of the art according to FIGS. 2, 3 and 4 have a lower actual signal strength and therefore a lower area of confidence. The losses of the signal strength of the code mark 83*a* with a short mark length λ1=4 mm according to FIGS. 2, 3 and 4 are so high that the sensors 85, 85' must be arranged at a low distance of only 3 mm above the code marks 83*a*. The arrangement of the sensors 85, 85' according to FIGS. 2, 3 and 4 is therefore limited by the signal strength since the sensor surfaces 850, 850' must lie within the confidence area with a tolerance of ±1 mm.

By contrast, in both embodiments according to the present invention shown in FIGS. 5-10B, the mark length λ2, λ3 is greater than 5 mm, preferably 6-10 mm, so that losses of the signal strength of the code marks 83*b*, 83*c* are avoided, which manifests itself in a larger area of confidence. This greater area of confidence allows the sensors 85 to be arranged not at a distance which is limited by the signal strength but at a distance above the code marks 83*b*, 83*c* which is determined by the guidance system. This allows the sensors 85, 85' to be arranged at a great distance of more than 6 mm above the code marks 83*b*, 83*c*. A further lengthening of the mark lengths causes a further increase in the area of confidence.

From FIGS. 4, 7A and 10A it can be seen that given confidence areas perpendicular to the line of the code marks must also be observed whose height diminishes with diminishing distance from the edges of the code marks 83*a*, 83*b*, 83*c*. In the aforementioned FIGS. 4, 7A and 10A, these areas of confidence in the perpendicular direction are symbolized by the curves Λ1, Λ2, and Λ3 respectively which mark the boundaries of the magnetic field strengths which are unequivocally detectable by the sensors.

Self-evidently, with knowledge of the present invention the expert can realize other code mark patterns and correspondingly constructed sensor devices. Thus, for example, more than two sensor groups arranged in parallel could be integrated in the sensor device so as to further increase the allowable offset between the sensor device and the code mark pattern.

Other physical principles for representing a longitudinal coding are also conceivable. For example, the code marks can have different relative permittivities that are read from a sensor device which detects a capacitive effect. Also possible is a reflective code mark pattern in which, depending on the value represented by the individual code marks, a greater or lesser quantity of reflected light is detected by a sensor device which detects reflected light.

The predetermined distance by which the sensor groups are separated from each other can be selected to permit the sensors of at least one of the two sensor groups to generate complete information regarding a current position of the car when a transverse deviation of the sensor device from a centered position relative to the line of the code marks does not exceed a value of 30% of a width of code marks.

The predetermined distance by which the sensor groups are separated from each other can be selected to permit the sensors of the two sensor groups to generate complete information regarding a current position of the car when a transverse deviation of the sensor device from a centered position relative to the line of the code marks does not exceed a value of 15% of a width of the code marks.

The analyzer 82 can compares information received from the two sensor groups and at least one of save and display deviation information if the information received deviates from each other over a defined period of time or during a defined number of trips of the car.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation having at least one car and at least one device for determining a position of the car, the position determining device comprising:

a code mark pattern arranged along a length of a path of travel of the car and being formed from a plurality code marks arranged in a single line;

a sensor device mounted on the car for scanning said code marks contactlessly with a plurality of sensors, said sensors being arranged in at least two groups for scanning said code marks redundantly and generating a signal from each group representing the scanned code mark pattern, and wherein said at least two sensor groups are separated from each other by a predetermined distance perpendicular to the line of said code marks and wherein said sensors of at least one of said at least two sensor groups are arranged in two sensor lines running parallel to the line of said code marks; and an analyzer connected to said sensor device for analyzing said signals generated by said sensor device to determine a current position of the car.

2. The elevator installation according to claim 1 wherein said predetermined distance by which said sensor groups are separated from each other permits said sensors of at least one of said at least two sensor groups to generate complete information regarding a current position of the car when a transverse deviation of said sensor device from a centered position relative to the line of said code marks does not exceed a value of 30% of a width of said code marks.

3. The elevator installation according to claim 1 wherein said predetermined distance by which said sensor groups are separated from each other permits said sensors of said at least two sensor groups to generate complete information regarding a current position of the oar when a transverse deviation of said sensor device from a centered position relative to the line of said code marks does not exceed a value of 15% of a width of said code marks.

4. The elevator installation according to claim 1 wherein when as a result of a transverse deviation of said sensor device from a centered position relative to the line of said code marks, said at least two sensor groups generate different information, said analyzer responds by combining the different information to determine the current position of the car.

5. The elevator installation according to claim 1 wherein said analyzer compares information received from said at least two sensor groups and at least one of saves and displays deviation information if the information received deviates from each other over a defined period of time or during a defined number of trips of the car.

6. An elevator installation having at least one car and at least one device for determining a position of the car, the position determining device comprising:

a code mark pattern arranged along a length of a path of travel of the car and being formed from a plurality code marks arranged in a single line;

a sensor device mounted on the car for scanning said code marks contactlessly with a plurality of sensors, said sensors being arranged in at least two groups for scanning said code marks redundantly and generating a signal from each group representing the scanned code mark pattern wherein said at least two sensor groups are separated from each other by a predetermined distance perpendicular to the line of said code marks; and an analyzer connected to said sensor device for analyzing said signals generated by said sensor device to determine a current position of the car and wherein said analyzer compares information received from said at least two sensor groups and at least one of saves and displays deviation information if the information received deviates from each other over a defined period of time or during a defined number of trips of the car.

7. The elevator installation according to claim 6 wherein said predetermined distance by which said sensor groups are separated from each other permits said sensors of at least one of said at least two sensor groups to generate complete information regarding a current position of the car when a transverse deviation of said sensor device from a centered position relative to the line of said code marks does not exceed a value of 30% of a width of said code marks.

8. The elevator installation according to claim 6 wherein said predetermined distance by which said sensor groups are separated from each other permits said sensors of said at least two sensor groups to generate complete information regarding a current position of the car when a transverse deviation of said sensor device from a centered position relative to the line of said code marks does not exceed a value of 15% of a width of said code marks.

9. The elevator installation according to claim 6 wherein said sensors of at least one of said at least two sensor groups are arranged in two sensor lines running parallel to the line of said code marks.

10. The elevator installation according to claim 6 wherein when as a result of a transverse deviation of said sensor device from a centered position relative to the line of said code marks, said at least two sensor groups generate different information, said analyzer responds by combining the different information to determine the current position of the car.

* * * * *

UNITED STATES PATENT AND TRADEMARK OFFICE

CERTIFICATE OF CORRECTION

PATENT NO. : 7,562,747 B2
APPLICATION NO. : 11/200469
DATED : July 21, 2009
INVENTOR(S) : Enrico Marchesi It is certified that error appears in the above-identified patent and that said Letters Patent is hereby corrected as shown below:

Under the Claims, Claim 1:
In col. 13 at line 24, “a plurality code” should be changed to “a plurality of code”.

Under the Claims, Claim 6:
In col. 14 at line 14, “a plurality code” should be changed to “a plurality of code”.

Signed and Sealed this
Fourteenth Day of August, 2012

David J. Kappos

David J. Kappos
*Director of the United States Patent and Trademark Office*